US009476250B2

(12) United States Patent
Danaud et al.

(10) Patent No.: US 9,476,250 B2
(45) Date of Patent: Oct. 25, 2016

(54) SASH WINDOW

(71) Applicant: ATELIERS PERRAULT FRERES, Saint Laurent de la Plaine (FR)

(72) Inventors: Pascal Danaud, Bourgneuf-en-Mauges (FR); Joël Bigeard, La Meignanne (FR); Antoine Lory, Beaucouze (FR)

(73) Assignee: ATELIERS PERRAULT FRERES, Saint Laurent de la Plaine (FR)

( * ) Notice: Subject to any disclaimer, the term of this patent is extended or adjusted under 35 U.S.C. 154(b) by 0 days.

(21) Appl. No.: 14/428,509

(22) PCT Filed: Sep. 20, 2012

(86) PCT No.: PCT/FR2012/052096

§ 371 (c)(1),
(2) Date: Mar. 16, 2015

(87) PCT Pub. No.: WO2014/044927

PCT Pub. Date: Mar. 27, 2014

(65) Prior Publication Data

US 2015/0247357 A1 Sep. 3, 2015

(51) Int. Cl.
*E06B 7/16* (2006.01)
*E06B 3/44* (2006.01)
(Continued)

(52) U.S. Cl.
CPC . *E06B 7/16* (2013.01); *E06B 3/44* (2013.01); *E06B 3/4407* (2013.01); *E06B 3/4415* (2013.01); *E06B 7/14* (2013.01); *E06B 7/23* (2013.01)

(58) Field of Classification Search
CPC ..... E06B 7/16; E06B 7/14; E06B 3/4407; E06B 3/44; E06B 7/23; E06B 3/4415
See application file for complete search history.

(56) References Cited

U.S. PATENT DOCUMENTS 3,896,589 A * 7/1975 Mitchell ..... E06B 1/34 49/425
4,624,073 A * 11/1986 Randall ..... E05D 15/22 292/164

(Continued)

FOREIGN PATENT DOCUMENTS

DE 19 36 132 A1 1/1971
EP 1 443 171 A1 8/2004

(Continued)

OTHER PUBLICATIONS

May 22, 2013 Search Report issued in International Application No. PCT/FR2012/052096.

*Primary Examiner* — Justin Rephann
(74) *Attorney, Agent, or Firm* — Oliff PLC; R. Brian Drozd

(57) ABSTRACT

A sash window includes a fixed frame in which at least one inner sliding frame can slide between an open position and a closed position of the window, and at least one sliding or fixed outer frame, seals being interposed between the fixed frame and the inner sliding frame, a sealing system including, for the inner sliding frame, two lateral seals, a top cross-member seal, for the outer frame, and a bottom cross-member seal. Additionally, the invention the sealing system includes intermediate seals that join on each side of the sliding frame the cross-member seals and the lateral seals, so as to form a continuity of sealing between these seals in the closed position of said inner sliding frame. The lateral junction region between the inner sliding frame and the outer frame is thus connected by a sealing system that makes them sealed vis-à-vis each other.

10 Claims, 6 Drawing Sheets

(51) Int. Cl.
*E06B 7/23* (2006.01)
*E06B 7/14* (2006.01)

(56) References Cited

U.S. PATENT DOCUMENTS

| | | | | | |
|---|---|---|---|---|---|
| 4,656,783 | A * | 4/1987 | Ahonen | E06B 3/44 | 49/404 |
| 4,941,288 | A * | 7/1990 | Morton | E06B 3/44 | 49/408 |
| 4,958,468 | A * | 9/1990 | Nolan | E06B 3/222 | 49/DIG. 2 |
| 5,042,199 | A * | 8/1991 | Schneider | E06B 3/44 | 49/446 |
| 5,274,955 | A * | 1/1994 | Dallaire | E06B 3/44 | 49/406 |
| 5,414,962 | A * | 5/1995 | Forbis | B29C 66/1142 | 49/414 |
| 5,649,389 | A * | 7/1997 | Coddens | E05D 15/22 | 49/176 |
| 6,067,754 | A * | 5/2000 | Bellart | E05D 15/0686 | 49/453 |
| 6,293,049 | B1 * | 9/2001 | Shaw | E06B 1/366 | 49/183 |
| 7,065,929 | B2 * | 6/2006 | Manzella | E06B 3/26347 | 52/204.1 |
| 7,174,939 | B1 * | 2/2007 | Spencer | E06B 3/44 | 160/90 |
| 7,246,466 | B2 * | 7/2007 | Turner | E06B 3/44 | 49/408 |
| 7,296,381 | B1 * | 11/2007 | McCabe | E06B 3/44 | 49/176 |
| 7,882,657 | B2 * | 2/2011 | Duncan | E05C 1/10 | 49/183 |
| 8,869,453 | B1 * | 10/2014 | Jordan | E06B 3/4407 | 49/404 |
| 2006/0150561 | A1 * | 7/2006 | Van Klompenburg | E05C 17/24 | 52/633 |
| 2007/0157520 | A1 * | 7/2007 | Daniels | E06B 3/44 | 49/163 |
| 2007/0157521 | A1 * | 7/2007 | Ito | E06B 3/5063 | 49/185 |
| 2007/0290456 | A1 * | 12/2007 | Speyer | E05C 19/002 | 277/628 |
| 2008/0060276 | A1 * | 3/2008 | Speyer | E06B 7/16 | 49/495.1 |
| 2008/0104892 | A1 * | 5/2008 | Cox | E06B 5/12 | 49/504 |
| 2008/0202033 | A1 * | 8/2008 | Hancock | E06B 3/303 | 49/472 |
| 2009/0031635 | A1 * | 2/2009 | Davis | E06B 7/16 | 49/478.1 |
| 2009/0199495 | A1 * | 8/2009 | Garries | E06B 3/44 | 52/204.1 |
| 2009/0199496 | A1 * | 8/2009 | Garries | E06B 1/702 | 52/213 |
| 2010/0205866 | A1 * | 8/2010 | Reithmeyer | E06B 7/14 | 49/408 |

FOREIGN PATENT DOCUMENTS

| | | | |
|---|---|---|---|
| EP | 1 965 012 | A1 | 9/2008 |
| EP | 2 088 275 | A2 | 8/2009 |
| FR | 2 209 884 | A1 | 7/1974 |
| WO | 2012/093382 | A1 | 7/2012 |

* cited by examiner

PL. 2/6

200
236
238
430
250a
C1
I1
216
214
350a
440
352
300b
210b
V
370
310b
360
354
I1
350a
350b
Exterior
Interior
230
360
354
212
V
I2
310b
380
300a
234
350b
232
352
420
410
100
C2
250b
D2

SASH WINDOW

The present invention relates to a sash window, that is to say a window comprising a fixed frame provided with at least one sliding frame, the fixed frame being intended to be disposed in a vertical or almost vertical plane and the sliding frame being able to slide from bottom to top and vice versa between an open position and a closed position of the window. This type of sash window is frequently used in countries that belonged to the British Empire and in northern Europe.

The fixed frame generally consists of profiles assembled in a framework, comprising two uprights in which one or more runners are provided for the sliding frame or frames to slide and two top and bottom cross members forming a stop for the sliding of said sliding frames. A compensation mechanism, using for example counterweights or springs, can be used so that the person manoeuvring a sliding frame does not have to support all its weight. A lock makes it possible to lock the sliding frame or frames in their closed position of the window.

The sealing of the sliding frames in their closed position is generally obtained by lateral seals held in the runners that act by natural compression on bearing surfaces, at the end of the installation of the window, whereas the horizontal sealing, that is to say top sealing on the top cross member, bottom on the bottom cross member, and between the sliding frames, in an overlap area, requires seals that are compressed only in the closed position of said sliding frames.

Unlike a casement window where the casements greatly compress the seals when they are closed, there remains a difficulty in sealing two regions situated laterally between two adjacent frames of a sash window.

Thus the applicant has sought a solution for increasing the level of sealing of a sash window, in particular to meet the requirements of certain standards.

SUMMARY

To this end a sash window is proposed comprising a fixed frame in which at least one inner sliding frame can slide, able to move between an open position and a closed position of the window, at least one sliding or fixed outer frame, seals being interposed between the fixed frame and said inner sliding frame, a sealing system comprising, for said inner sliding frame, two lateral seals, a top cross-member seal, for the outer frame, and a bottom cross-member seal; according to the invention, the sealing system comprises intermediate seals that join each side of the sliding frame, the cross-member seals and the lateral seals, so as to form a continuity of sealing between these seals in the closed position of said inner sliding frame.

The lateral junction region between the inner sliding frame and the outer frame is thus connected by a sealing system that makes them sealed relative to each other.

According to an additional feature of the invention, the intermediate seals comprise two connecting seals held in contact respectively with the two lateral seals and which bear on the two ends of the top cross-member seal of said inner sliding frame in its closed position.

These intermediate seals work between the lateral seals and the cross-member seals of the inner sliding frame in order to effect a sealed connection between them.

According to an additional feature of the invention, the intermediate seals comprise two end seals respectively sandwiched between the two ends of the cross-member seals in the closed position of the inner sliding frame.

These end seals procure continuity of perimeter sealing between the two cross-member seals, in this way closing off two lateral passages between the inner sliding frame and the outer frame.

According to an additional feature of the invention, the lateral seals are held in two uprights forming the fixed frame, being applied against the front face of two corresponding uprights constituting the inner sliding frame, and the window comprises a bottom seal held in the bottom cross member of said inner sliding frame, the bottom seal being put in contact by broadening against ends of the lateral seals, bearing on the bottom cross member of the fixed frame.

In this way continuity of sealing in a U shape between the ends of the bottom seal and the lateral seals of the inner sliding frame is obtained.

According to an additional feature of the invention, the outer frame is of the sliding type, the intermediate seals comprise two other connecting seals held in contact respectively with two other lateral seals retained in the two uprights of the fixed frame while being applied against the front face of two corresponding uprights constituting the outer sliding frame, said first other connecting seals bearing on the two ends of the bottom cross-member seal of said outer sliding frame in its closed position, a top seal being held in the top cross member of said outer sliding frame, the top seal being put in contact by broadening against the ends of said second other lateral seals while bearing on the top cross member of the fixed frame.

Perimeter sealing of the outer sliding frame is achieved by this arrangement of seals.

According to an additional feature of the invention, a first gap is provided between the framework of the fixed frame and the front face of the top cross member as well as the front face of the two uprights of the outer sliding frame, and the width of which is sufficiently small to prevent drops of water passing.

The presence of this gap prevents water, coming for example from driving rain, entering as far as the seals of the outer sliding frame.

According to an additional feature of the invention, the first gap emerges in a first pressure-balancing chamber that communicates with the two lateral seals of the outer sliding frame as well as with the top seal, said chamber having an inverted U shape, the bottom ends of its two vertical branches being emergent.

These seals are thus subjected, on their exposed parts on the outside of the window, to the outside barometric pressure. The absence of any overpressure assists the sealing work of the seals. The chamber being emergent at the bottom part, the water liable to enter therein is discharged therefrom, keeping the seals dry in order to guarantee their effectiveness.

According to an additional feature of the invention, the fixed frame comprises two vertical separation strips and a second gap is provided between the two vertical strips and the front face of the two uprights of the inner sliding frame, and the width of which is sufficiently small to prevent drops of water passing.

The presence of this gap prevents water, coming for example from driving rain, entering as far as the seals of the inner sliding frame.

According to an additional feature of the invention, the second gap emerges in a second pressure balancing chamber that communicates with the two lateral seals of the inner sliding frame, said chamber having a U shape, the bottom horizontal arm of which is connected to at least one drain.

These seals are thus subjected, on their exposed parts on the outside of the window, to the external barometric pressure. The absence of overpressure assists the sealing work of the seals. Since the chamber emerges at the bottom part through the drain, any water liable to enter therein is discharged therefrom, keeping the seals dry in order to guarantee their effectiveness.

According to an additional feature of the invention, the free ends of the two vertical branches of the two chambers are closed off by inserts that hold the connecting seals respectively in place, the inserts closing the bottom ends of the two vertical branches of the first chamber being perforated to enable any water droplets to be discharged.

These inserts have several functions; they serve as a support for the fixing of the connecting seals, they serve as drains at the bottom part of the vertical branches of the first chamber, and they close off the top outlets of the vertical branches of the second chamber.

According to an additional feature of the invention, the window is provided with means for positioning at least one sliding frame, active in its closed position, and which are designed to prestress respectively the lateral seals of said or each sliding frame against the front faces of the uprights of said sliding frame.

The seals, being pressed on their bearing faces, function well and are more effective.

BRIEF DESCRIPTION OF THE DRAWINGS

The features of the invention mentioned above, as well as others, will emerge more clearly from a reading of the following description of an example embodiment, said description being given in relation to the accompanying drawings, among which.

DETAILED DESCRIPTION

Figure 1:
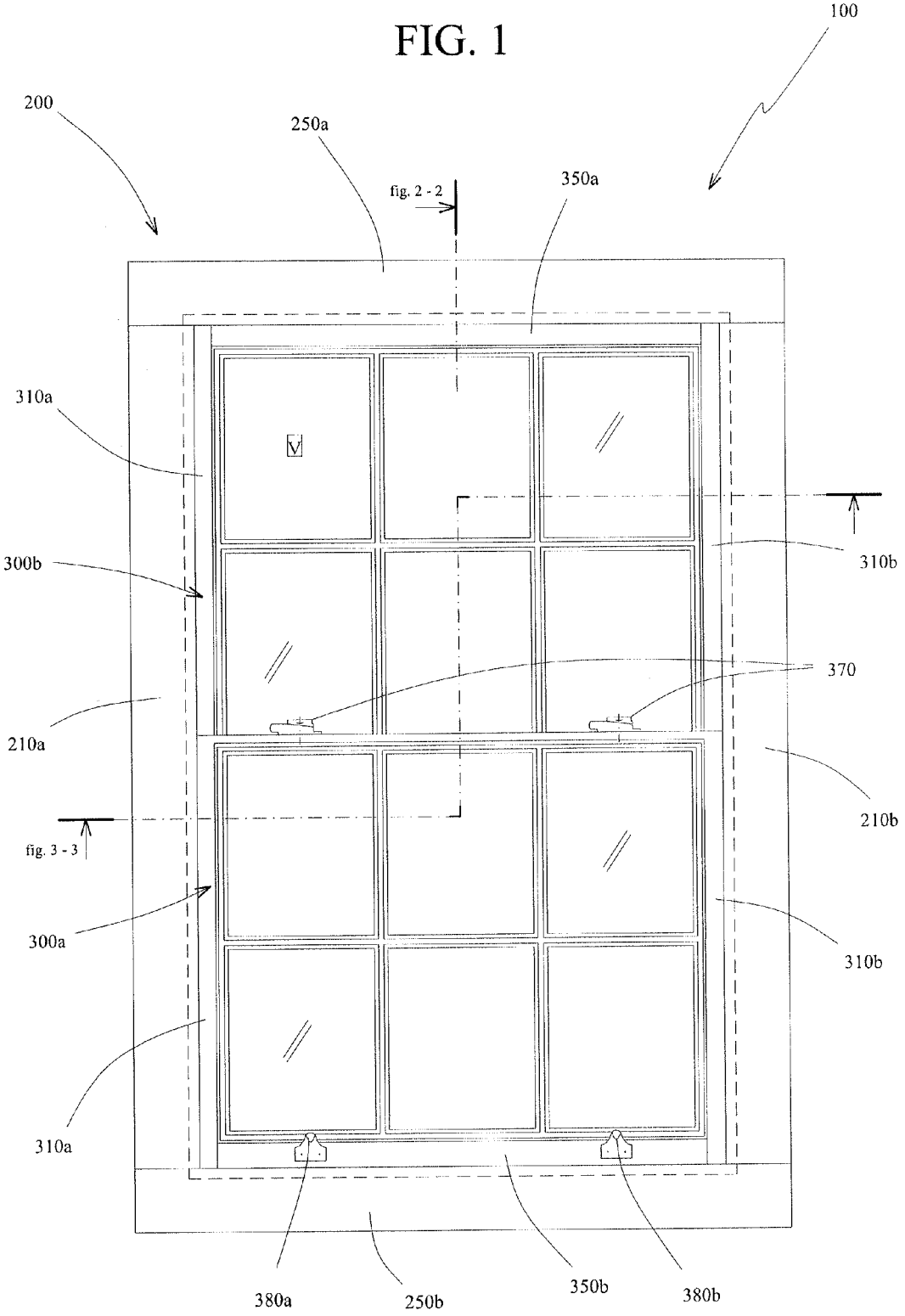
FIG. 1 depicts a front view of a sash window seen from its inside according to the invention.

The sash window 100 presented in FIG. 1 is intended to be installed vertically or almost vertically in a wall opening of a dwelling or building.

It consists of a fixed frame 200 and two sliding frames 300*a*, 300*b*, able to move between an open position allowing air to enter through said window and a closed position of the window. The movement of each sliding frame is ascending or descending in the position in which the window is installed. The inner sliding frame 300*a*, that is to say the one that is recessed, is disposed at the bottom whereas the outer sliding frame 300*b* is disposed at the top. It should be noted however that the outer sliding frame 300*b* may be replaced, in a variant embodiment of the window that is not shown, by a fixed outer frame, so that window is opened by opening only the inner sliding frame 300*a*. The window may also incorporate, in another variant embodiment that is not shown, an intermediate sliding frame disposed between the two frames 300*a* and 300*b*.

The fixed frame 200 consists of a framework formed by two uprights 210 joined at their two ends respectively by two cross members 250, a top cross member 250*a* and a bottom cross member 250*b*. The fixed frame is advantageously constructed from wood firstly for its relatively good thermal insulation coefficient and secondly for the distinction of this material and the quality appearance that it procures for the window.

Figure 2:
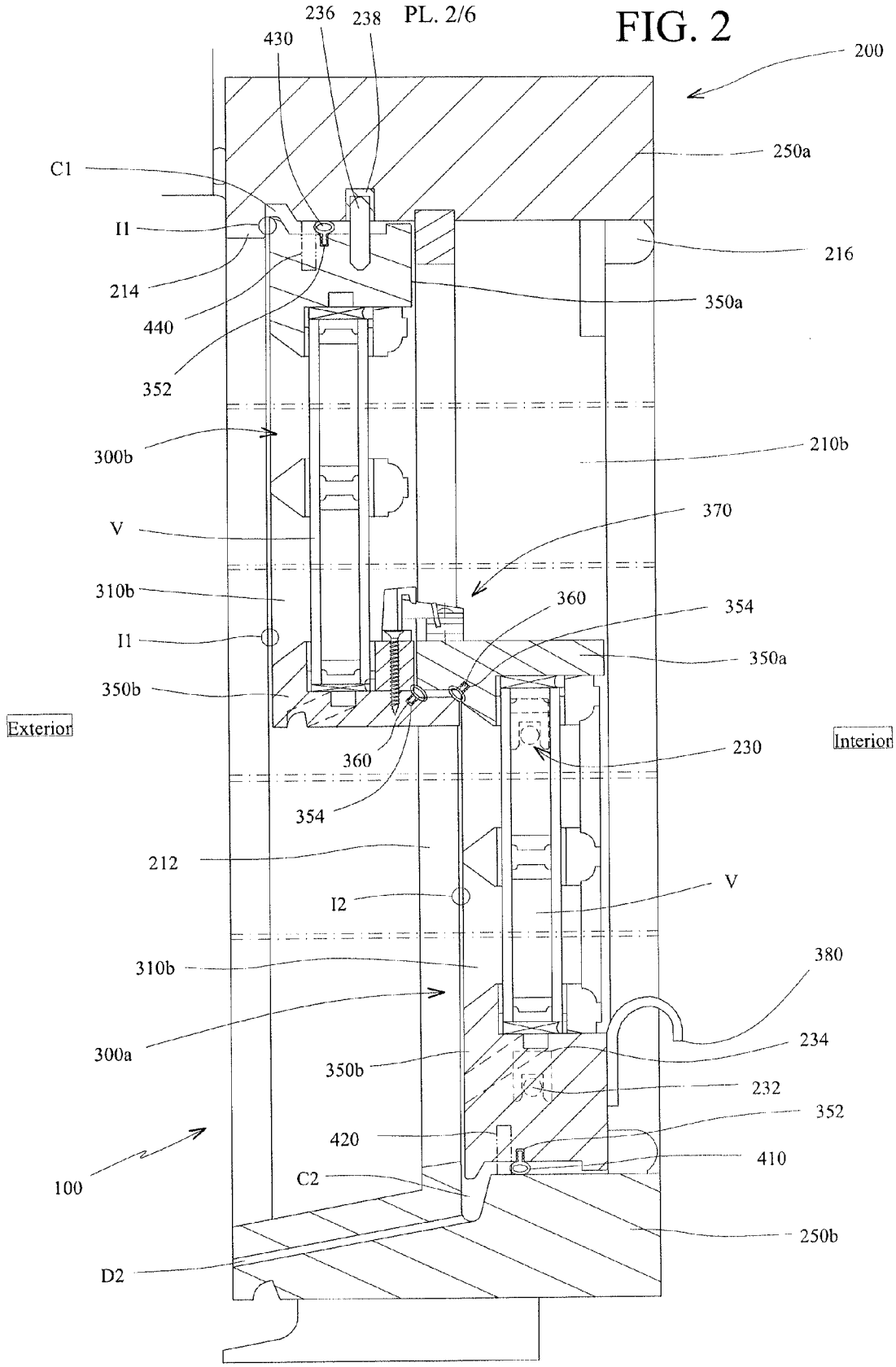
FIG. 2 depicts a view in longitudinal section of a sash window according to the invention.

In FIG. 2, a separation strip 212 is fixed in a longitudinal groove in each upright 210 in order to separate the two sliding frames. Each upright 210 is bordered on its face intended to be turned towards the outside with an extension in a return 214 forming, with the strip 212, a vertical guidance roller for the outer sliding frame 300*b*. The extension in a return 214 issues from the top cross member 250*a* and the two uprights 210.

Attached elements 216 are fixed at the emergence of the framework through its inner frame forming, with the strip 212, a vertical guide runner for the inner sliding frame 300*a*.

In FIGS. 1 and 2, each sliding frame 300 consists also of a framework formed by two uprights 310 joined at their two ends respectively by two cross members, a so-called top cross member 350*a* and a so-called bottom cross member 350*b*. A glass pane V is kept trapped in the framework of each sliding frame.

At least one latch 370 is fixed to the cross members turned facing the two sliding frames 300*a* and 300*b* in their closed position in order to be able to lock them mutually in this position. Two latches 370 are visible in FIG. 1.

At least one manoeuvring means 380, such as a gripping handle, is fixed to the bottom cross member 350*b* of the inner sliding frame 300*a*.

Figure 3:
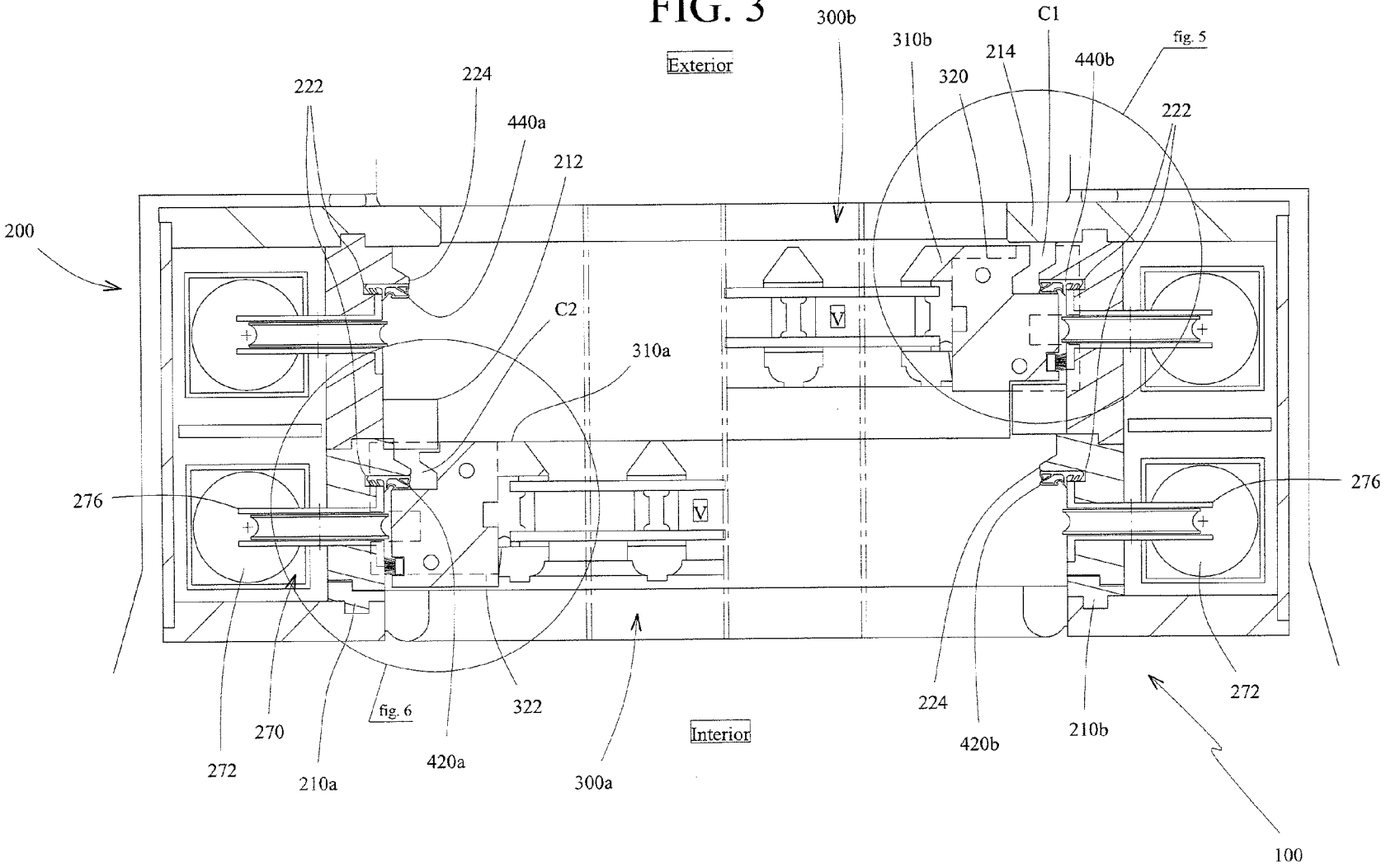
FIG. 3 depicts a view in transverse section of a sash window according to the invention.

So that the user does not have to lift the whole weight of the sliding frame when it is opened, each sliding frame 300 is assisted, in FIG. 3, by a means 270 for compensating for its weight, so that manoeuvring it is easier. This compensation means comprises, in this FIG. 3, two counterweights 272 mounted for sliding in the uprights 210 of the fixed frame and which are attached to a sliding frame by means of links (not shown) passing round two pulleys 276 anchored at the top part of the fixed frame. The compensation means may also comprise springs.

In order to obtain a relatively high level of airtightness and watertightness between the sliding frames and the fixed frame, a sealing system has been developed and, for at least one sliding frame, a drainage system and a pressure-balancing chamber downstream of the sealing system, that is to say on its side turned towards the outside.

Figure 4:
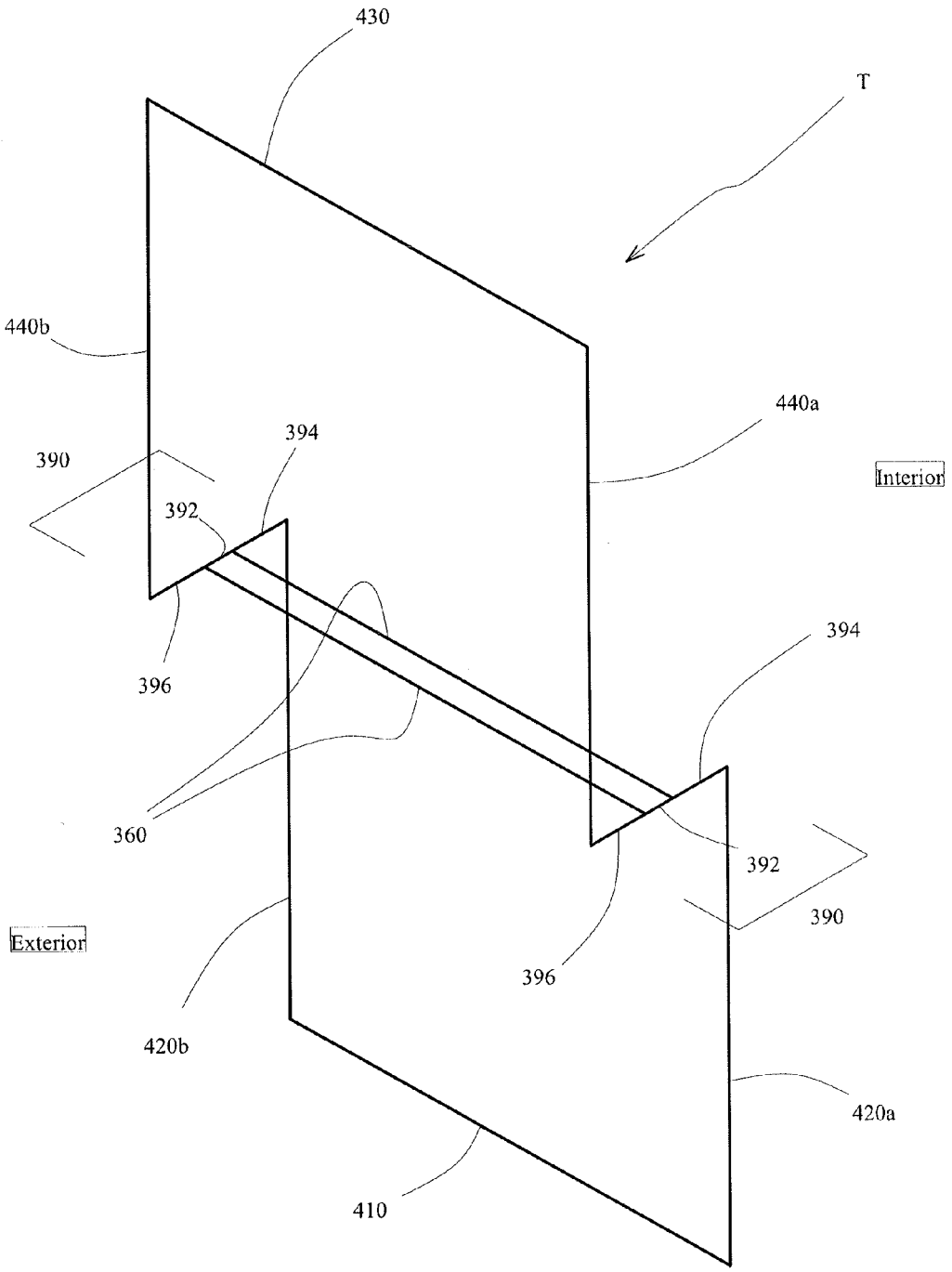
FIG. 4 depicts a schematic view in perspective of a sealing system for a sash window according to the invention.

In FIG. 4, the sealing system T comprises, for the inner sliding frame, a bottom seal 410 and two lateral seals 420*a* and 420*b*, intended to be interposed between said inner sliding frame and the fixed frame. It also comprises, for the outer sliding frame, a top seal 430 and two lateral seals 440*a* and 440*b*, intended to be interposed between said outer sliding frame and the fixed frame.

In FIG. 2, the bottom seal 410 is composed of a flexible profile comprising an anchoring nose housed in a groove 352 produced longitudinally in the width of the bottom cross member 350*b* of the inner sliding frame 300*a*, the anchoring nose being connected to a sealing weatherstrip, advantageously with a circular cross section. In the closed position of the inner sliding frame 300*a*, visible in this FIG. 2, the bottom seal 410 is put in contact, while broadening, on the inner face of the bottom cross member 350*b*. The anchoring nose is bordered by fir-tooth shaped fins for increasing retention thereof in said groove.

It will be noted, in this FIG. 2, that the circular cross section of the bottom seal 410 becomes elliptical and therefore broadened in the closed position of the inner sliding frame 300*a* so that it comes into contact with a flat sealing part of the lateral seal 420, represented by a dot-and-dash line in this FIG. 2, procuring continuity of sealing between the bottom seal and the two lateral seals 420.

In FIG. 3, each lateral seal 420*a* and 420*b* has roughly a rectangular cross section comprising, on one edge, an anchoring part housed in a groove 222 produced longitudinally over at least part of the height of the corresponding upright 210 and more precisely a little more than the height of the inner sliding frame 300*a*, when it is disposed in its closed position, and, from its other edge, said flat sealing part intended to come into contact with the front face of a corresponding upright 310 of the inner sliding frame 300*a*. Each lateral seal 420*a* and 420*b* has up against it a wall opposite to the flat sealing part and which extends the anchoring part, on a rim 224 that projects perpendicularly on the inner face of each upright 210, in line with a side of said groove. The rim 224 is disposed so that the flat sealing part is turned inwards.

This rim extends over the entire useful length of the seal, that is to say over at least part of the height of the corresponding upright 210 and more precisely a little more than the height of the inner sliding frame 300*a*, when it is disposed in its closed position.

In FIG. 4, this continuity of sealing between these three seals 420*a*, 410 and 420*b* has a U shape.

The same arrangement of seals is found overall for producing the sealing between the outer sliding frame and the fixed frame. There are thus, with reference to FIG. 2, a top seal 430 identical to the bottom seal and anchored in the same way in a groove 352 produced in the top cross member 350*a* of the outer sliding frame 30*b*.

In FIG. 3, each lateral seal 440*a*, 440*b* is identical to its homologue 420 and is housed in a groove 222, one side of which extends so as to form a rim 224.

There also, and with reference to FIG. 4, a continuity of sealing is obtained between these three seals 440*a*, 430 and 440*b*, which has an inverted U shape "⊓".

To complete this sealing, so as to obtain perimeter continuity and sealing between the sliding frames, the sealing system T also comprises two sliding inter-frame seals 360 referred to as cross-member seals, since they work between the top cross member of the inner sliding frame and the bottom cross member of the outer sliding frame, and intermediate seals 390 arranged so as firstly to join the ends of the two cross-member seals 360 and secondly to join the lateral seals 420, 440 of the two sliding frames in their closed position.

In FIG. 2, each cross-member seal 360 is composed of a flexible profile comprising an anchoring nose housed in a groove 354 produced longitudinally in the width of the bottom cross member 350*b* of the outer sliding frame 300*b* and in the width of the top cross member 350*a* of the inner sliding frame 300*a*, the anchoring nose being joined to a sealing weatherstrip. The grooves 354 are preferably produced aslant, for example at 45°, while being parallel to each other. They are produced in the faces turned opposite the two cross members 350 so that the seal housed in the groove of one cross member 350*a* can come into contact with a bevelled corner bordering the face of the other cross member 350*b* and vice versa, and this in the closed position of the two sliding frames 300.

In FIG. 4, the intermediate seals 390 are composed, on each side of the window, of an end seal 392 and two connecting seals 394 and 396. Each end seal 392 consists of a slat fixed against the corresponding upright of the fixed frame and is positioned so as to be able to be sandwiched between the two cross-member seals 360 in the closed position of the sliding frames in order to procure continuity of sealing at the ends of the two cross-member seals 360.

Each connecting seal 394 is fixed at the top part of the upright of the inner sliding frame in order to come into contact with the flat sealing part of the corresponding lateral seal and also comes to bear on the end of a top cross-member seal 360 in the closed position of said sliding frame.

Each connecting seal 396 is fixed at the bottom part of the upright of the outer sliding frame in order to come into contact with the flat sealing part of the corresponding lateral seal and also comes to bear on the end of the other bottom cross-member seal 360 in the closed position of said sliding frame.

Under these conditions, continuity of sealing is obtained between the two pairs of adjoining lateral seals, via the connected ends of the two cross-member seals, procuring in this way a sealed connection at the periphery of each sliding frame and between the two sliding frames, in their closed position.

This sealing system T that equips the sash window of the invention forms, without discontinuity, a sealed perimeter bead on the one hand around the two sliding frames and on the other hand between the two sliding frames, when they are closed.

The sealing system T is thus in a position to satisfy the requirements of the permeability to air of the windows having regard to the requirements of certain current standards, among which let us cite the standard NF DTU 36-5 for France, the standard CAN3-A440-M84 for Canada and the standard E 283-84 for the United States. The French standard, for example provides for a test for permeability to air where the maximum pressure reaches 600 Pa.

Impermeability to moisture and to driving rain has been obtained by having found a solution for firstly preventing the sealing system T being impacted by the presence of traces of moisture and on the other hand preventing despite everything any presence of water in contact with the seals being able to impair their sealing.

Figure 5:
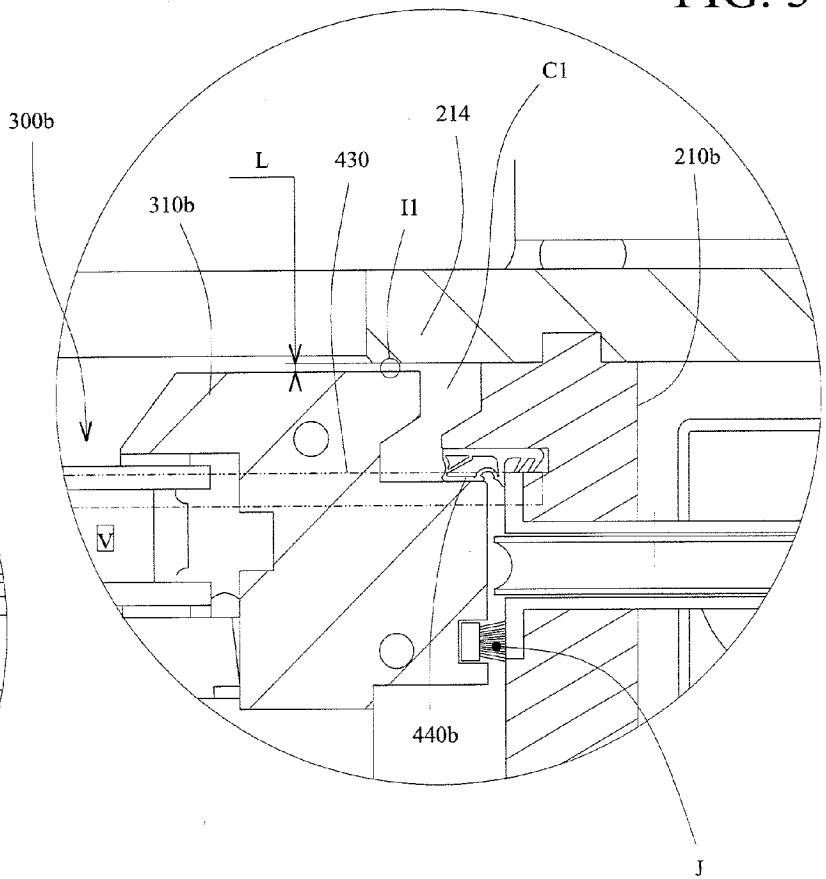
FIG. 5 depicts a first detail of a view in transverse section of a sash window, showing a gap connected to a pressure-balancing chamber according to the invention.

In the detailed view in FIG. 5, a gap I1 remains for this purpose between the rear face of the extension in a return 214 and the front face of the two uprights 310 and the front face of the top cross member of the outer sliding frame (not visible in this FIG. 5, but apparent in FIG. 2). Its width L is such that it can stop the passage of drops of water or driving rain in order to prevent their presence affecting the correct functioning of the seals. The width L of this gap I is preferably less than 1.5 mm. The gap I1 is also visible in FIG. 2.

The gap I1 emerges in a pressure-balancing chamber C1 situated at the rear of the extension in a return 214. It is delimited firstly between each upright 210 of the fixed frame 200 and each upright 310 of the outer sliding frame 300*b* and secondly between the top cross member of the fixed frame and the top cross member of the outer sliding frame (not visible in this FIG. 5 but apparent in FIG. 2). It communicates by juxtaposing them with the two lateral seals 440 as well as with the top seal 430 represented in this FIG. 5 by a discontinuous line. These seals are thus subjected, on their parts exposed on the outside of the window, to the external biometric pressure. The absence of overpressure assists the sealing work of the seals.

Figure 7:
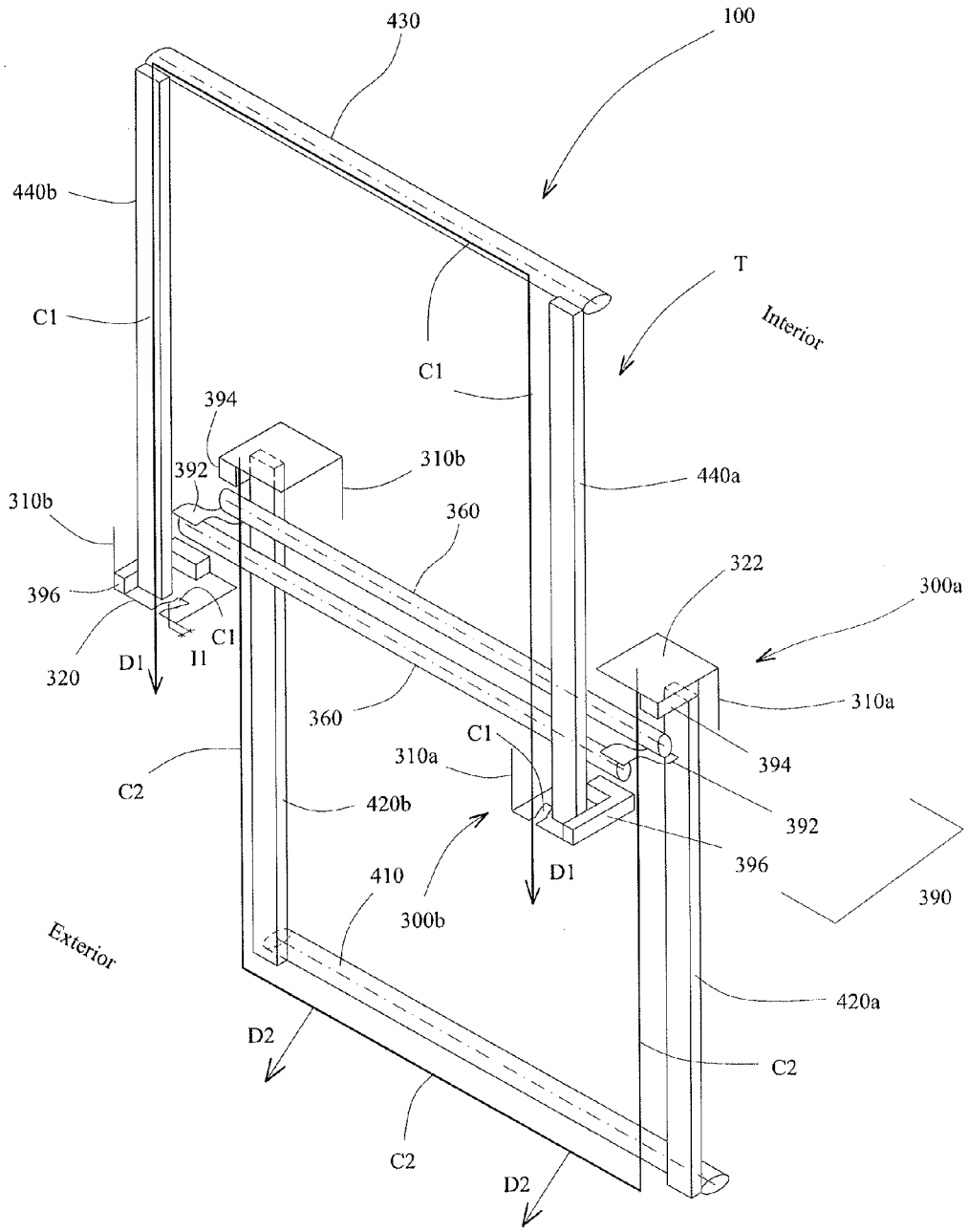
FIG. 7 depicts a view in perspective of a sealing system and two pressure-balancing chambers in a sash window according to the invention.

The chamber C1 has the shape of an inverted U "⊓", identifiable by its three branches in FIG. 7. It emerges through the bottom ends of its two vertical branches, thus effecting drainage of any traces of water that might have been able to enter despite everything as far as contact with said seals. The drainage is represented by the arrows D1. It is achieved below the uprights 310 of the outer sliding frame 300*b* through closure inserts 320 described in detail below.

Figure 6:
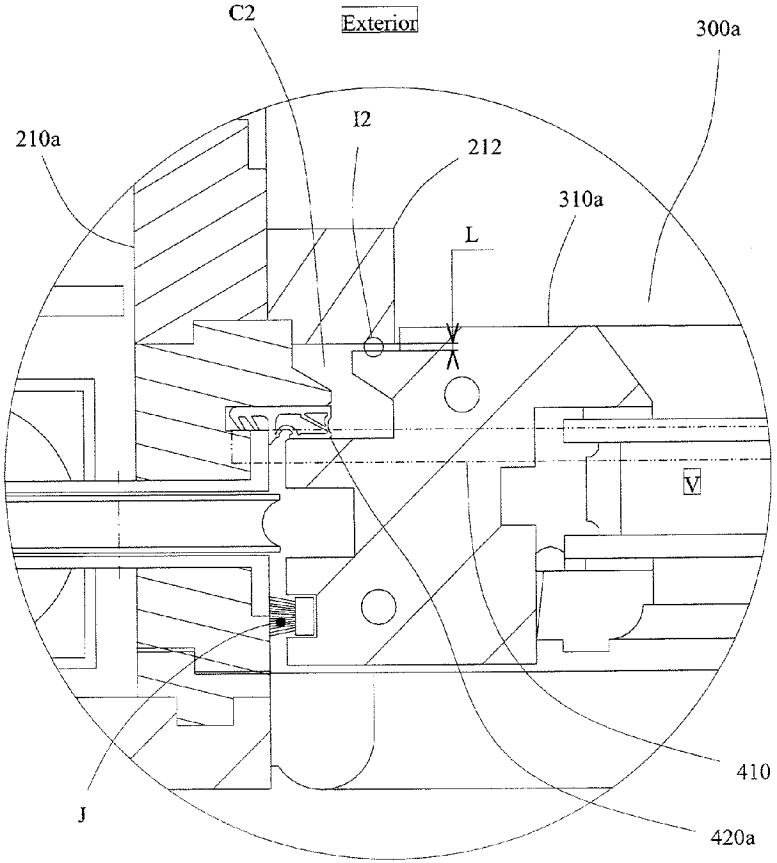
FIG. 6 depicts a second detail of a view in transverse section of a sash window, showing another gap connected to another pressure-balancing chamber according to the invention.

With reference to FIG. 6, a second gap 12 is delimited between each strip 212 and a recess on the front face of each upright 310 of the inner sliding frame 300*a*. Its width L is preferably less than 1.5 mm. The gap 12 emerges in another pressure-balancing chamber C2 situated at the rear of the two strips 212. It is delimited between the two strips 212 and the two uprights 310 of the inner sliding frame 300*a*. In FIG. 7, the chamber C2 has a U shape identifiable by its three branches. Its horizontal bottom branch is connected to at least one drain represented by the arrows D2 and here two in number. In FIG. 2, the drain D2 is the form of an inclined conduit passing through the bottom cross member 250*b* of the fixed frame 200 so as to be connected to the intermediate branch of the chamber C2 in order to discharge the water collected, through the front face of said bottom cross member, lower down and outside.

In FIGS. 5 and 6, the presence of brush seals J can be noted, intended to limit the natural operating clearance of the sliding frames 300 in the fixed frame 200. They are disposed in grooves produced longitudinally along the lateral edges of the uprights 310 of the sliding frames.

In FIG. 7, two closure inserts 320 are fixed to the bottom cross member of the outer sliding frame 300*b* while being disposed in line with two outlets of the chamber C1, that is to say level with the free ends of its vertical branches. They are perforated so that any droplets drained in the chamber C1 can be discharged under said sliding frame. They also serve as a support for the connecting seals 396.

Similarly, two other closure inserts 322 are fixed to the top cross member of the inner sliding frame 300*a* level with the top outlet of the two vertical branches of the chamber C2. They are solid, that is to say closed in order to close off the two top outlets so as to keep the inner sliding frame 300*a* sealed at this point. They also serve as a support for the connecting seals 394. The inserts 320 and 322 are also visible in FIG. 3, where it can be seen that the insert 320 is perforated in line with the vertical branch of the chamber C1 and the insert 322 is closed, in this way closing off the vertical branch of the chamber C2.

The pressure-balancing chambers C1 and C2 procure favourable technical conditions for the seals by preventing their being wetted and avoiding variations in pressure on their sides exposed to the outside of the window.

In FIG. 2, the window 100 is provided with means 230 for positioning at least one sliding frame 300, active in its closure position, and which are designed to prestress respectively the lateral seals 420 and/or 440 of said sliding frame against their bearing surfaces, that is to say the front faces of the uprights 300. These positioning means comprise, in respect of one of the sliding frames and here the inner frame 300*a*, two pairs of pins 232 fixed to the inner faces of the two uprights 210 of the fixed frame 200, and two pairs of corresponding arches 234 fixed to the uprights 310 and which straddle the pins in the closure position of said sliding frame.

The positioning means 230 for the other sliding frame 300*b* advantageously comprise two fingers 236 secured to the top cross member 350*a* of said sliding frame and which can fit in two corresponding insertions 238 fixed in the top cross member 250*a* of the fixed frame 200. The bottom part of this outer sliding frame 300*b* is pressed against the lateral seals 440 by manoeuvring the latches 370, which are in this way designed so as to position the bottom part of the outer frame 300*b* with respect to the top part of the inner frame 300*a*, itself positioned on the uprights 310 through its positioning means 230.

The sash window of the invention achieves performances with regard to sealing which rival those of casement windows. The arrangement of its seals and the presence of pressure-balancing chambers confer on it in fact a level of airtightness and watertightness that satisfy current standards and in particular the standards NF P 20.302 of May 2008 and NF EN 12207 of May 2000.

Its framework, preferably manufactured from wood, procures for it a beautiful appearance while limiting thermal losses.

The invention claimed is:

1. A sash window comprising:

a fixed frame, at least one inner sliding frame that is configured to slide between an open position and a closed position of the window, at least one sliding or fixed outer frame, wherein a sealing system comprises seals that are interposed between the fixed frame and said inner sliding frame, said sealing system comprising:

two lateral seals, a top cross-member seal, a bottom cross-member seal, and intermediate seals that join on at least two sides of the inner sliding frame the cross-member seals and the lateral seals, so as to form a continuity of sealing between the cross-member seals and the lateral seals in the closed position of said inner sliding frame, wherein the intermediate seals comprise two end seals respectively sandwiched between two ends of the cross-member seals in the closed position of the inner sliding frame.

2. The sash window according to claim 1, wherein the intermediate seals comprise two connecting seals maintained in contact respectively with the two lateral seals and which bear on two ends of the top cross-member seal of said inner sliding frame in the closed position.

3. The sash window according to claim 1, wherein the lateral seals are retained in two uprights constituting the fixed frame while being applied against a front face of two corresponding uprights constituting the inner sliding frame, and in that the sash window further comprises a bottom seal held in a bottom cross member of said inner sliding frame, the bottom seal contacting ends of the lateral seals while bearing on a bottom cross member of the fixed frame.

4. The sash window according to claim 3, wherein the fixed frame comprises two vertical separation strips and a gap is formed between the two vertical strips and the front face of the two corresponding uprights of the inner sliding frame, and the width of which is sized to prevent drops of water passing.

5. The sash window according to claim 4, wherein the gap emerges in a pressure-balancing chamber that communicates with the two lateral seals of the inner sliding frame, said chamber having a U shape, a horizontal bottom branch of which is connected to at least one drain.

6. The sash window according to claim 1, wherein the outer frame is of the sliding type, the intermediate seals comprising two connecting seals held in contact respectively with two other lateral seals held in two uprights of the fixed frame while being applied against a front face of two corresponding uprights constituting the outer sliding frame, said connecting seals bearing on two ends of the bottom cross-member seal of said outer sliding frame, in its closed position, and in that a top seal is held in a top cross member of said outer sliding frame, the top seal contacting ends of said other lateral seals while bearing on a top cross member of the fixed frame.

7. The sash window according to claim 6, wherein a gap is formed between a framework of the fixed frame and a front face of the top cross member of the outer sliding frame as well as the front face of the two corresponding uprights of the outer sliding frame and the width of which is sized to prevent drops of water passing through the gap.

8. The sash window according to claim 7, wherein the gap emerges in a pressure-balancing chamber that communicates with the two other lateral seals of the outer sliding frame, as well as with the top seal, said chamber having an inverted U shape and comprising two vertical branches having openings in bottom ends of the two vertical branches.

9. The sash window according to claim 8, wherein free ends of the two vertical branches of the chamber are closed off by inserts that hold in place the connecting seals, the inserts closing off the bottom ends of the two vertical branches of the chamber being perforated to enable any droplets of water to be discharged.

10. The sash window according to claim 1, further comprising means for positioning at least one sliding frame that, when the at least one sliding frame is in a closed position, is designed to engage a lateral seal of said two lateral seals of said at least one sliding frame against a front face of an upright of said at least one sliding frame.

* * * * *